US011787511B2

(12) United States Patent
Rostrøm et al.

(10) Patent No.: US 11,787,511 B2
(45) Date of Patent: Oct. 17, 2023

(54) METHODS AND DEVICES FOR PREDICTING VESSEL BOW MOTION

(71) Applicant: Ørsted Wind Power A/S, Fredericia (DK)

(72) Inventors: Morten Paranhos Perdomo Santos Rostrøm, Gentofte (DK); Mikkel Haugaard Windolf, Gentofte (DK); Niels Agner Jensen, Gentofte (DK)

(73) Assignee: Ørsted Wind Power A/S

( * ) Notice: Subject to any disclaimer, the term of this patent is extended or adjusted under 35 U.S.C. 154(b) by 149 days.

(21) Appl. No.: 17/255,256

(22) PCT Filed: Jun. 24, 2019

(86) PCT No.: PCT/EP2019/066719
§ 371 (c)(1),
(2) Date: Dec. 22, 2020

(87) PCT Pub. No.: WO2020/007637
PCT Pub. Date: Jan. 9, 2020

(65) Prior Publication Data

US 2021/0129952 A1 May 6, 2021

(30) Foreign Application Priority Data

Jul. 4, 2018 (EP) ..... 18181713

(51) Int. Cl.
*B63B 27/14* (2006.01)
*B63B 79/10* (2020.01)
(Continued)

(52) U.S. Cl.
CPC ..... *B63B 27/14* (2013.01); *B63B 27/00* (2013.01); *B63B 79/10* (2020.01); *B63B 79/15* (2020.01); *B63B 79/30* (2020.01); *B63B 2201/00* (2013.01)

(58) Field of Classification Search
CPC ..... B63B 27/14; B63B 79/15; B63B 79/30; B63B 27/00; B63B 79/10; B63B 2201/00
See application file for complete search history.

(56) References Cited

U.S. PATENT DOCUMENTS

2007/0000424 A1 1/2007 Clarkson et al.
2010/0070118 A1* 3/2010 Yamada ..... B63B 49/00 701/21

(Continued)

FOREIGN PATENT DOCUMENTS

DE 102015108882 B3 7/2016
EP 2520485 B1 3/2015

(Continued)

OTHER PUBLICATIONS

"Predict Actual Shipmotions Due to Sea Waves Minutes Ahead of Time", Next Ocean, The Wayback Machine, Available at: "https://web.archive.org/web/20180118222912/https://www.nextocean.nl/" 2017, 15 pages.

(Continued)

*Primary Examiner* — Stephen Holwerda
(74) *Attorney, Agent, or Firm* — Condo Roccia Koptiw LLP

(57) ABSTRACT

A method for the use in offshore crew transfer when transferring a person between a crew transfer vessel and a structure or vice versa where a prediction system for predicting vessel bow motion in response to sea waves detected by said wave detection device is used. An indicator is adapted to indicate a prediction of vessel bow motion below a first bow motion threshold value within a first predetermined time period based on said prediction system. The transfer of the person only takes place when said vessel bow motion is indicated to be below the first vessel bow motion threshold value within the first predetermined time period.

20 Claims, 2 Drawing Sheets

(51) Int. Cl.

| | |
|---|---|
| ***B63B 79/30*** | (2020.01) |
| ***B63B 79/15*** | (2020.01) |
| ***B63B 27/00*** | (2006.01) |

(56) References Cited

U.S. PATENT DOCUMENTS

| | | | | |
|---|---|---|---|---|
| 2014/0114509 | A1* | 4/2014 | Venables | B63B 39/06 701/21 |
| 2015/0307160 | A1* | 10/2015 | Clarkson | B63B 27/30 114/230.24 |
| 2015/0375831 | A1* | 12/2015 | Taylor | B65G 67/603 414/803 |
| 2016/0355241 | A1* | 12/2016 | Longman | B63B 39/04 |
| 2018/0081028 | A1 | 3/2018 | Kusters et al. | |
| 2019/0084657 | A1* | 3/2019 | Oestrem | G07C 5/0808 |
| 2019/0161152 | A1* | 5/2019 | Kusters, Jr. | G01S 13/88 |

FOREIGN PATENT DOCUMENTS

| | | | |
|---|---|---|---|
| JP | 2016-044556 | A | 4/2016 |
| WO | 2016/192719 | A1 | 12/2016 |

OTHER PUBLICATIONS

Hilmer et al., "Deterministic Wave Predictions from the WaMoS II", IEEE, 2014, 8 pages.

Wassink, Jos, "Benefits of Wave Watching Rewarded", Delta Journalistic Platform TU Delft, Science, Oct. 13, 2017, 6 pages.

* cited by examiner

METHODS AND DEVICES FOR PREDICTING VESSEL BOW MOTION

CROSS REFERENCE TO RELATED APPLICATIONS

This application is the National Stage Entry under 35 U.S.C. § 371 of Patent Cooperation Treaty Application No. PCT/EP2019/066719, filed Jun. 24, 2019, which claims priority from European Application No. 18181713.1, filed Jul. 4, 2018, the contents of which are hereby incorporated by reference herein in their entireties.

BACKGROUND

Operation and service of offshore wind farms may necessitate a service crew to be sailed to an offshore location by boat, referred to hereinafter as the crew transfer vessel. At the offshore location, the persons who are part of or form the service crew need to be transferred from the crew transfer vessel to a structure to perform the service. Also, equipment or cargo may need to be transferred. The structure is typically a fixed structure such as a wind turbine or a platform on a fixed foundation, but could also be a floating structure anchored or not. Likewise, the persons need to transfer back to a crew transfer vessel from the structure.

Because of the sea waves, be it local wind driven waves or sea swells coming from far away, the crew transfer vessel will be in motion and typically move with respect to the structure to or from which the transfer is to take place. Such relative motion poses a risk to the safe transfer of persons.

A normal countermeasure is to push the bow of the crew transfer vessel against the structure using the crew transfer vessel's propulsion and manoeuvring system to create friction between the bow and the structure. To cushion and increase friction the bow is typically fitted with a rubber cushion. If the sea waves are not too big, this will keep the bow in permanent engagement with the structure in the sense that there is no relative motion, which could endanger the safe transfer. If, however, the sea waves become too big, there is a risk of sudden slip of the engagement between the bow and the structure and a sudden rapid motion of the vessel bow along the structure be it upwardly or downwardly in a vertical direction, to the side or away from the structure.

Whether this risk for slipping exists for a given sea wave pattern, is currently the call of the skipper or other responsible person on the crew transfer vessel. If this call is made too conservatively, valuable time and resources are lost, because personnel are not transferred. Thus, service of e.g. a wind turbine may be delayed. Such a delay is generally not desired but since stronger winds generally produce larger waves, the service of a non-producing wind turbine may be delayed at the very times where production potentials are high, and may thus incur unnecessary additional losses.

On this background, it is the object of the present invention to increase the time periods where safe transfer between a crew transfer vessel and a structure may take place.

SUMMARY

The present invention relates to a system for predicting vessel bow motion of a crew transfer vessel and a method for the use in offshore crew transfer when transferring a person between a crew transfer vessel and a structure.

The present invention takes its outset in the operation and service of offshore wind farms, but is applicable on a wide range of other offshore operations.

According to a first aspect of the invention, this object is achieved by a method for the use in offshore crew transfer when transferring a person between a crew transfer vessel and a structure or vice versa where the crew transfer vessel comprises a propulsion and manoeuvring system, a wave detection device adapted for detecting sea waves, a prediction system for predicting vessel bow motion in response to sea waves detected by said wave detection device, an indicator adapted to indicate a prediction of vessel bow motion below a first bow motion threshold value within a first predetermined time period based on said prediction system, said method comprising the steps of: pressing said crew transfer vessel against said structure using said propulsion and manoeuvring system, detecting said sea waves using said wave detection device, based on said detected sea waves, predicting using said prediction system whether vessel bow motion will be below the first bow motion threshold value within the first predetermined time period, and if so indicating this using the indicator, and transferring the person only when said vessel bow motion is indicated to be below the first vessel bow motion threshold value within the first predetermined time period.

According to a second aspect of the invention, the object is solved by a system for predicting vessel bow motion of a crew transfer vessel comprising a propulsion and manoeuvring system, a wave detection device, and a bow motion detection system, said system comprising a predictor adapted to receive data sets indicative of a sea wave pattern from said wave detection device, to receive data sets indicative of vessel bow motion and to correlate said data sets indicative of sea wave patterns with said data sets indicative of sea wave patterns, so as to be able to make predictions based on experienced correlation between said data sets indicative of sea wave patterns and data sets indicative of vessel bow motion, and based on said prediction outputting a prediction of vessel bow motions to be experienced within a first time period after the receipt of a data set indicative of a sea wave pattern from said wave detection device.

Introducing a prediction system of this kind in a method of crew transfer allows the real time assessment of the bow motion risk in response to each individual data set produced by the wave detection device in relation to waves, and thus a continuous real time assessment of the risk of vessel slip beyond a certain threshold within the near future. This prediction will take place in real time based on each individual data set and will therefore be much more precise than the skipper's estimate, even if he is experienced. This, in turn, provides a safe time window during which safe transfer may take place. Furthermore, the prediction may yield a simple go or no-go result that can easily be presented and interpreted on the indicator to the person to be transferred and those assisting in the transfer.

According to a preferred embodiment of the first aspect of the invention the indicator is adapted to indicate a second prediction of vessel bow motion below a second bow motion threshold value within a second predetermined time period based on said prediction system, where said second bow motion threshold value is lower than said first bow motion threshold value and said second predetermined time period, and transferring the person only when said vessel bow motion is indicated to be below the second vessel bow motion threshold value within the second predetermined time period. This may open up a further window allowing distinction between times where less experienced persons may transfer, and times where only more experienced persons may transfer.

Preferably, according to a further preferred embodiment of the first aspect of the invention, a safety line is attached to the structure, and the attachment of the person to the safety line is not performed until said vessel bow motion is indicated to be below the first vessel bow motion threshold value within the first predetermined time period. This further increases safety, because the prediction and the indicator allows the person to be transferred only to be attached to the safety line once there is a sufficiently long period available for the transfer. There is thus little risk that the bow would slip, leaving the person hanging in the safety line in the middle of the transfer.

According to yet another preferred embodiment of the first aspect of the invention, the structure is a fixed structure. The motion of the crew transfer vessel is easier to predict with respect to a fixed structure, and therefor renders itself most useful, for such transfers. It is however not excluded that the structure could be a floating structure, e.g. an anchored platform or even another vessel.

According to a further preferred embodiment according to the first aspect of the invention, the prediction system comprises an adaptive algorithm, which is continuously trained during operation using input data sets from the wave detection device and from a bow motion detector. This constantly improves current prediction, and improves the quality of the predictions of the prediction system over time, thus increasing safety.

According to a preferred embodiment of the second aspect of the invention, the predictor is furthermore adapted to add new correlations of data sets indicative of sea wave patterns with said data sets indicative of sea wave patterns to said experienced correlations. In this way, better predictions of a specific vessel's behaviour will be achieved, in turn allowing more transfer opportunities to be indicated and more transfers to be performed. Accordingly, according to a further preferred embodiment of the second aspect of the invention, the system further comprises an indicator for indicating the result of said prediction.

According to a further preferred embodiment of the second aspect of the invention the predictor is adapted to further correlate the experience to a given location. Thus, not only the vessel's own response to waves in general may be factored in but also specific characteristics of wave patterns at a given location. Thus, for a wind farm in general, or even individual wind turbines thereof, an even better prediction is achieved. This would of course also be the case for other relevant structures, such as service platforms, oil rigs etc. positioned at a specific location.

According to yet a further adapted to output an indication of optimum angle of docking based on said prediction. This allows the skipper to dock the crew transfer vehicle at an angle to the structure predicted to minimize the risk of slipping above the predetermined thresholds.

BRIEF DESCRIPTION OF THE DRAWINGS

The invention will now be described in greater detail based on non-limiting exemplary embodiments and with reference to the drawings, on which.

DETAILED DESCRIPTION

Figure 1:
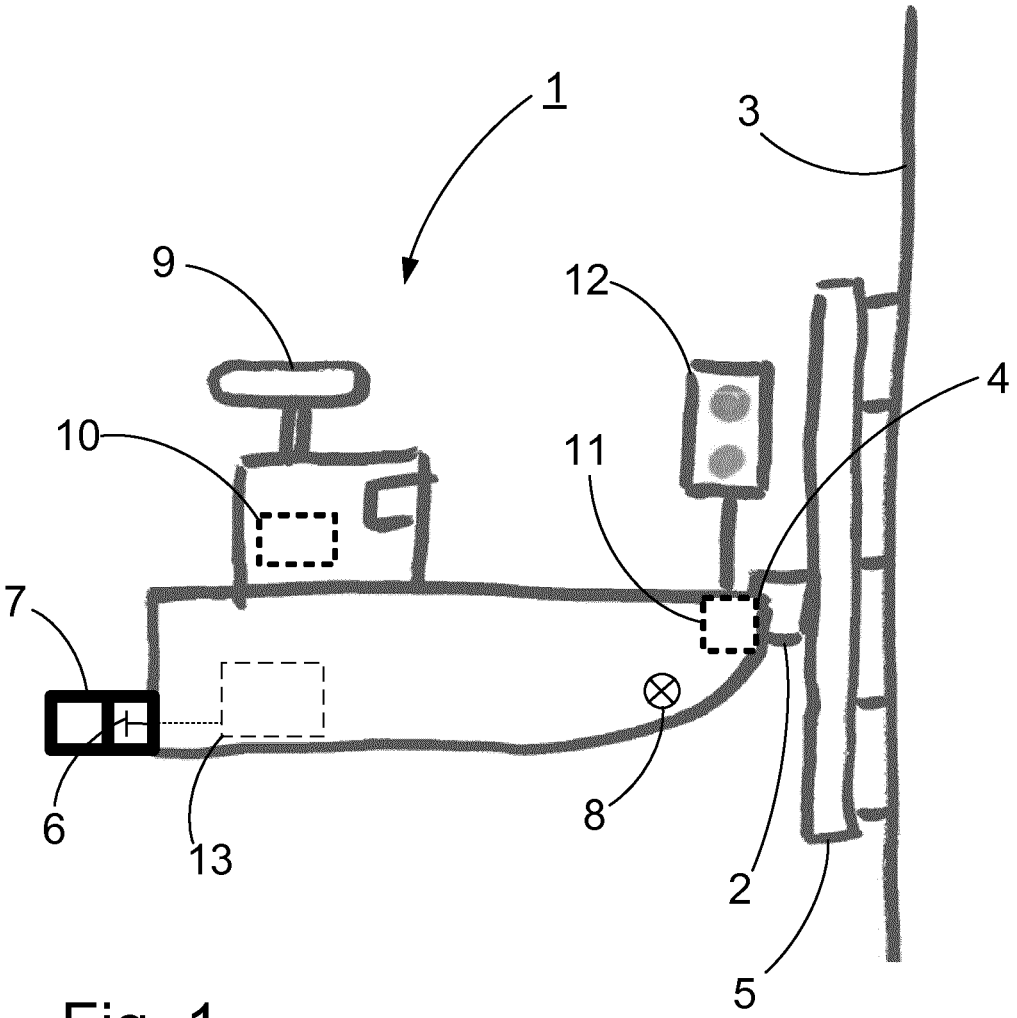
FIG. 1 shows a crew transfer vessel pressed against an offshore structure.

Turning first to FIG. 1 a crew transfer vessel 1 is shown with the bow 2 pressed against a structure 3, such as a monopile foundation of an offshore wind turbine, more specifically a buffer 4 at the bow 2 is pressing against vertical columns 5 protecting the entry ladder providing access to the structure 3. The crew transfer vessel 1 is not moored but merely pressed against the structure 3 by means of its propulsion and manoeuvring system, e.g. comprising engine 13, propeller 6, rudder, 7 and possibly bow propellers 8. Ideally, if pressed firmly enough against the structure, the bow will not move but form a pivotal point about which the crew transfer vessel 1 will still perform pitch, roll and yaw motions. However, in practice waves of a certain energy, e.g. depending on magnitude and velocity, and direction will still be able cause the bow 2 to move in sudden movements with respect to the structure 3, in the following referred to as slipping. Such sudden movements may pose a risk to persons, cargo or equipment if it happens in the transfer process between the crew transfer vessel and the structure or vice versa, even when strapped in harness and attached to security lines attached to the structure 3. The present invention reduces this risk by making qualified predictions on when and for how long such slipping is unlikely, and conversely on when such slipping is imminent.

Figure 2:
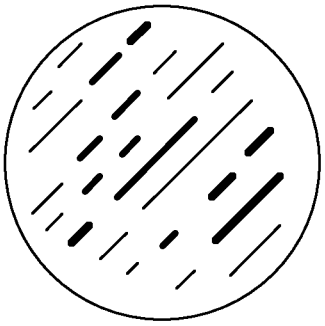
FIG. 2 illustrates a wave pattern detected by the radar of the crew transfer vessel, FIG. 3 schematically illustrates magnitude of bow displacement over time as detected by motion detection device on the crew transfer vessel.
Figure 3:
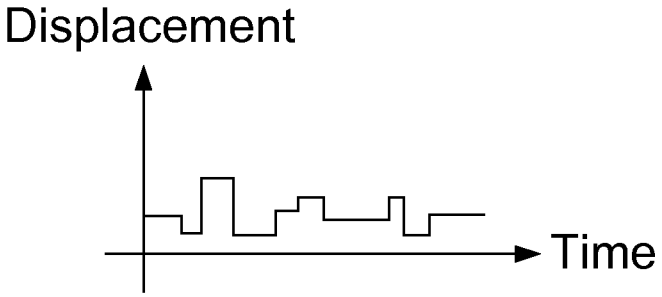

The basis for this prediction is the continuous series data sets recorded by a wave detection device 9 of the crew transfer vessel 1, such as an x-band radar. As an alternative to radar for remote detection of waves, other means such as LIDAR or other laser ranging, microwave detection or the like could be used. In the following explanation of preferred embodiments the use of a radar will be assumed, but the invention is not limited thereto. These data sets represent sea wave patterns filtered out of the returned radar signals from the radar 9, as exemplified in FIG. 2. These data sets are fed to a predictive algorithm running on a computer 10, preferably located on the crew transfer vessel 1. The predictive algorithm is also fed with continuous data sets indicating the bow motion of the crew transfer vessel 1. The bow motion may be detected using a bow motion detector 11, such as an accelerometer, at the bow 2, a fine resolution GNSS receiver or any other suitable detector.

The predictive algorithm is preferably a machine learning algorithm trained to correlate detected wave patterns, based on the data sets from the radar, and the data sets indicating the bow motion, recorded during prior crew transfer operations and/or training sessions. When properly trained, the predictive algorithm will be able to output a simple result indicative of whether within a predetermined duration from a detected sea wave pattern, the bow 2 of the crew transfer vessel 1 will experience slipping above a certain threshold or not. This, in turn, may serve as a readily understandable indication to persons to be transferred and those assisting them that transfer is now possible without the risk of the bow 2 slipping, so that persons are only transferred during such indication. Typically, a 30 second time interval is sufficient for the transfer including the attachment of the person to security lines, so the predictive algorithm may set an indicator 12 to "go" or "green" if no slipping above e.g. 30 cm will take place within the next 30 seconds. If not, "no-go" or "red" may be indicated instead. For psychological reasons, an indication of "no-go" is preferred as addition to "go", but in principle only the indication of one or the other suffices. Most people are familiar with the concept of traffic lights, and it is therefore preferred to simply use red and green lights on the indicator 12 to signal "go" or "no-go". The analogy will also implicitly be used in the following description.

The duration of bow motions below a given threshold, i.e. the 30 seconds mentioned above, is selected to be so long that there is sufficient time to attach the person in harness to the safety line(s) attached to the structure 3. There is thus no risk that the bow 2 of the crew transfer vessel 1 suddenly falls away below the person leaving him suspended from the safety line.

Since, however, all persons to be transferred are not equally trained, experienced, and agile it may be preferably not just to have the above mentioned simple "go" and "no go" indication, but also have an intermediate level for better trained and more experienced persons. Since such persons will generally be able to cope better with slipping of the bow 2 and perform the transfer more quickly, they could be allowed to transfer when the risk of bow 2 slipping below a higher threshold, which may generally be more likely and therefore have a longer duration.

So if a first threshold is set at e.g. 60 cm and this is not going to be exceeded for say 30 or 15 seconds, or possibly even a shorter duration the indicator 12 could indicate "possible" or "yellow", until prediction yields below 30 cm for the next 30 second and goes "green" or, as the case may be, goes "red" because both thresholds are predicted to be exceeded within the duration. So, the transfer period is extended, because distinction can be made between good conditions i.e. "yellow condition", where experienced persons may transfer, and very good conditions. i.e. "green condition" where also less experienced persons may transfer. Also in this embodiment of the invention a presentation similar to a traffic light is preferred.

Figure 4:
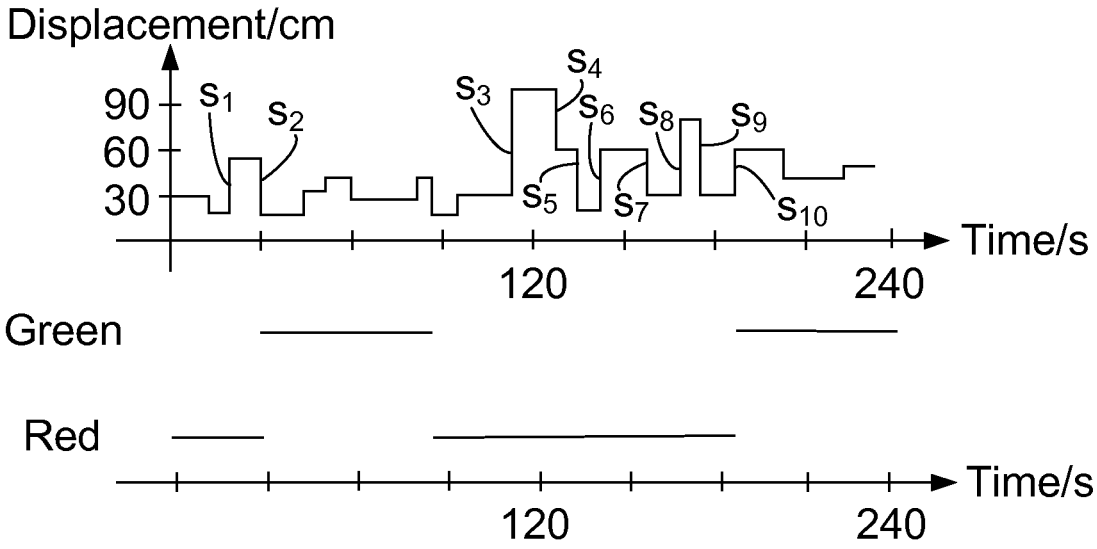
FIG. 4 illustrates predicted bow displacement over time along with two level output signals for an indicator on board of the crew transfer vessel.
Figure 5:
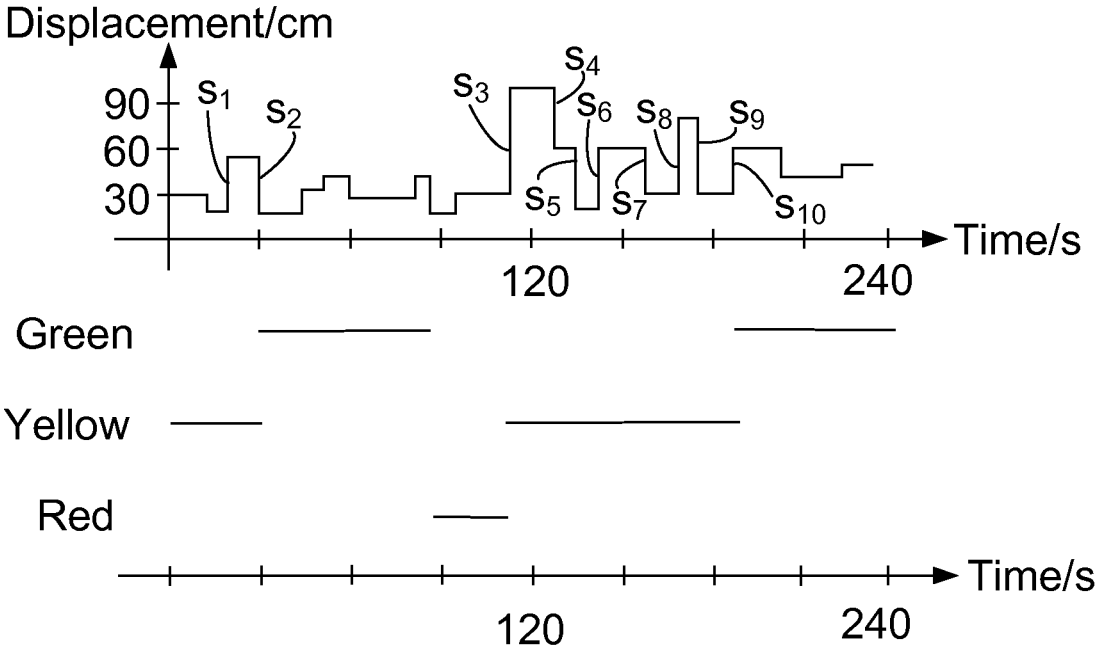
FIG. 5 illustrates predicted bow displacement over time along with three level output signals for an indicator on board of the crew transfer vessel.

This can be seen by comparison between FIGS. 4 and 5, illustrating the above predictions of slips and resulting indications with thresholds of 30 cm and 60 cm for "green condition" and "yellow condition", respectively, within 30 second duration.

Turning first to FIG. 4, a predicted bow displacement over a 240 s time interval from a given point in time t=0 is illustrated. A number of significant slips $s_1$-$s_{10}$ up and down have been predicted, significant meaning larger than 30 cm. As can be seen, the prediction at t=0 yields two slips $s_1$ and $s_2$ larger than 30 cm within the next 30 s and the indication is thus "red". At the time of the slip $s_1$, the next predicted slip $s_2$ is still predicted within 30 s and the indication would remain "red". Thereafter, no slips are predicted until the rather big slip $s_3$ and indication would remain "green" until 30 s before the predicted slip $s_3$. After $s_2$, a long sequence of significant slips $s_4$-$s_{10}$ are predicted and the indication would remain red until after the slip $s_{10}$. In this respect, it should be noted that with each new data set from the radar 9 and from the bow motion detector 11 the prediction is updated, and all the above "would be's" may change as prediction may improve as they approach in time. Thus, approximately after the approximately 40 s when the slip $s_1$ has occurred predictions may have changed so $s_2$ is predicted to be below the threshold and the indication may already then change to "green". As it is all about prediction, it may even be that the predictions for both $s_1$ and $s_2$ change before the time when $s_1$ is initially predicted to occur and indication is set to "green" (or "red") before then.

Turning now to FIG. 5, the same situation at t=0 is considered for an indication using two thresholds of 30 cm and 60 cm, respectively. Here, as can be seen, only the largest slip $s_3$ would yield a "red" indication. The slips s4-s10 are predicted to be between 30 cm and 60 cm and thus yield a "yellow" condition and an indication thereof. The duration of the time of predicted "red" condition is substantially reduced as compared to FIG. 4.

It should be emphasized that the above thresholds and time period are merely examples for illustration of the invention As indicated above, prediction is constantly updated based on new radar data sets and bow motion data sets, and the predictive algorithm constantly learns more about the crew transfer vessels behaviour when pressed against a structure 3. The mere pressing of the crew transfer vessel 1 against a structure makes the prediction difficult, and even if the response of the vessel 1 to wind, waves current etc. in general is known to some extent e.g. when floating free, the pressing against a structure 3 makes exact modelling of the response in that situation impossible. A predictive algorithm has been found to yield useful results, without exact modelling of each and every situation that may be experienced when pressed against a structure 3 even based solely on radar data and bow motion data.

Prediction may, however, be improved if the predictive algorithm is trained with additional input parameters. One such parameter could be the force with which the crew transfer vessel 1 is pressed against structure 3, e.g. based on utilized engine power or thrust. Another such parameter could be the geographic location of the crew transfer vessel 1. This would allow the predictive algorithm to also learn or incorporate local factors typical for the location, such as wind, waves, swells, current etc. Alternatively, the algorithm could be specifically trained for specific locations, so that an algorithm trained for the location of the transfer could be utilized. This could be a specific training for a specific structure (monopile, jacket, floating foundation or any other structures known to a person skilled in the art) or a more general training for a larger area such as an offshore wind farm.

Furthermore, already while approaching the structure, the predictions based on prior knowledge of wave patterns may be put into use. For instance a prediction of "dockability" may be forecast. So if predictions by the prediction system yield that a high risk of slipping exists, this could be indicated to the skipper, thus also relieving him of the decision on whether to dock or not.

Also, since the risk of slipping depends on the orientation of the crew transfer vessel 1 with respect to the wave patterns angle, the prior knowledge of the response of the crew transfer vessel 1 to wave patterns, the prediction system may give an indication to the skipper as to how to approach and dock, e.g. the optimal angle for a given wave pattern to push the crew transfer vessel 1 against the structure at, i.e. an angle yielding the best predictions for slipping under the predetermined thresholds.

As will be understood, according to the invention, the prediction and indication system as described above is used in a method where the person is only transferred when said vessel bow motion is indicated to be below the first vessel bow motion threshold value within the first predetermined time period.

The invention claimed is:

1. A method of predicting a motion of a vessel bow in response to sea waves, comprising:

pressing the vessel bow against a structure;

detecting a sea wave pattern;

establishing a first position of the vessel bow on the structure;

determining subsequent movement of the vessel bow with respect to the established first position on the structure, thereby creating a data set indicative of slip between the vessel bow and the structure;

correlating the sea wave pattern with the data set indicative of vessel slip;

based on the correlation, predicting whether the vessel bow will slip more than a predetermined distance in a predetermined time interval representing a threshold; and if the predicted vessel slip is greater than the threshold, displaying a first indication on a display located at the vessel bow; and if the predicted vessel slip is less than the threshold, displaying a second indication on the display located at the vessel bow;

transferring a person or cargo to the structure only while the second indication is displayed.

2. The method of claim 1, further comprising attaching a safety line to a person only while the second indication is displayed.

3. The method of claim 1, further comprising based on the correlation, predicting whether the vessel bow will slip more than a second predetermined distance in a second predetermined time interval representing a second threshold, wherein the second threshold falls within the threshold.

4. The method of claim 3, further comprising if the predicted vessel slip is less than the second threshold, displaying a third indication, wherein the third indication is an intermediate indication between the first indication and the second indication.

5. The method of claim 1, further comprising detecting a current pattern.

6. The method of claim 1, further comprising determining a location of the structure and incorporating historical data from the location comprising one or more of seawave patterns, current patterns, and vessel slip.

7. The method of claim 6, further comprising suggesting an optimum angle of docking for the vessel.

8. The method of claim 1, further comprising creating a continuous data set for the sea wave pattern.

9. The method of claim 1, further comprising creating a continuous data set for the vessel slip.

10. An onboard system for a vessel, comprising:

a wave detection device for detecting sea waves and producing data sets;

a bow motion detector for establishing a first position of the vessel bow when pressed against a structure and determining subsequent movement of the vessel bow with respect to the established first position on the structure, thereby creating a data set indicative of slip between the vessel bow and the structure;

a prediction system comprising an adaptive algorithm which is continuously trained during operation using input data sets from the wave detection device and from the bow motion detector to correlate a sea wave pattern with the vessel slip; and a display located at the vessel bow;

wherein the prediction system predicts whether the vessel bow will slip more than a predetermined distance in a predetermined time interval representing a threshold, and wherein, if the predicted vessel slip is greater than the threshold, the display provides a first indication, and if the predicted vessel slip is less than the threshold, the display provides a second indication, the second indication signifying that it is safe to transfer a person or cargo to the structure.

11. The system of claim 10, further comprising a Global Navigation Satellite System (GNSS) receiver for determining location.

12. The system of claim 11, further comprising incorporating historical data from the location comprising one or more of seawave patterns, current patterns, and vessel slip into the prediction system.

13. The system of claim 10, wherein the wave detection device comprises one or more of radar, Light Detection and Ranging (LIDAR), and microwave detection.

14. The system of claim 10, wherein the bow motion detector comprises one or more of an accelerometer and a fine resolution GNSS receiver.

15. The system of claim 12, wherein the display further displays an optimum angle of docking for the vessel.

16. The system of claim 10, wherein the prediction system predicts whether the vessel bow will slip more than a second predetermined distance in a second predetermined time interval representing a second threshold, wherein the second threshold falls within the threshold.

17. The system of claim 16, wherein if the predicted vessel slip is less than the second threshold, displaying a third indication, wherein the third indication is an intermediate indication between the first indication and the second indication.

18. The system of claim 17, wherein the display provides a red light for the first indication, a yellow light for the third indication, and a green light for the second indication.

19. An onboard system for a vessel, comprising:

a wave detection device for detecting sea waves and producing data sets;

a bow motion detector for establishing a first position of the vessel bow when pressed against a structure and determining subsequent movement of the vessel bow with respect to the established first position on the structure, thereby creating a data set indicative of slip between the vessel bow and the structure;

a prediction system comprising a machine-learning adaptive algorithm which is continuously trained during operation using input data sets from the wave detection device and from the bow motion detector to correlate a sea wave pattern with the vessel bow slip; and a display located at the vessel bow;

wherein the prediction system predicts whether the vessel bow will slip more than a first predetermined distance in a predetermined time interval representing a first threshold, whether the vessel bow will slip more than a second, lesser, predetermined distance in the predetermined time interval representing a second threshold, and wherein, if the predicted vessel slip is greater than the first threshold, the display provides a first indication, wherein, if the predicted vessel slip is less than the first threshold, the display provides a second indication, the second indication signifying that it is safe to transfer a person or cargo to the structure, and wherein, if the predicted vessel slip is within the second threshold, displaying a third indication, wherein the third indication is an intermediate indication between the first indication and the second indication.

20. The system of claim 19, wherein the display provides a red light for the first indication, a green light for the second indication, and a yellow light for the third indication.

* * * * *